US009772591B2

(12) United States Patent
Taniguchi et al.

(10) Patent No.: US 9,772,591 B2
(45) Date of Patent: Sep. 26, 2017

(54) IMAGE FORMING APPARATUS AND IMAGE FORMING SYSTEM

(71) Applicant: CANON KABUSHIKI KAISHA, Tokyo (JP)

(72) Inventors: Satoru Taniguchi, Mishima (JP); Wataru Uchida, Yokohama (JP); Hiroyuki Yamazaki, Mishima (JP); Toshifumi Kitamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/039,823

(22) PCT Filed: Nov. 18, 2014

(86) PCT No.: PCT/JP2014/005773
§ 371 (c)(1),
(2) Date: May 26, 2016

(87) PCT Pub. No.: WO2015/079650
PCT Pub. Date: Jun. 4, 2015

(65) Prior Publication Data

US 2016/0378034 A1 Dec. 29, 2016

(30) Foreign Application Priority Data

Nov. 29, 2013 (JP) ..... 2013-248443

(51) Int. Cl.
*G03G 15/00* (2006.01)

(52) U.S. Cl.
CPC ..... *G03G 15/5016* (2013.01); *G03G 15/502* (2013.01); *G03G 15/553* (2013.01)

(58) Field of Classification Search
None
See application file for complete search history.

(56) References Cited

U.S. PATENT DOCUMENTS

| | | | | |
|---|---|---|---|---|
| 7,257,337 | B2 | 8/2007 | Amico | |
| 2007/0177439 | A1* | 8/2007 | Saito | B41J 3/46 365/190 |
| 2010/0259774 | A1* | 10/2010 | Kamisuwa | G06F 3/1204 358/1.9 |
| 2012/0002994 | A1* | 1/2012 | Moroney | G03G 15/5016 399/72 |

FOREIGN PATENT DOCUMENTS

| | | | |
|---|---|---|---|
| EP | 1316857 | A2 | 6/2003 |
| JP | 2000-131978 | A | 5/2000 |
| JP | 2005-115221 | A | 4/2005 |
| JP | 2007-25048 | A | 2/2007 |
| JP | 2011-8120 | | 1/2011 |
| JP | 2011-8120 | A | 1/2011 |
| JP | 2011-43825 | A | 3/2011 |

* cited by examiner

*Primary Examiner* — Thomas Giampaolo, II
(74) *Attorney, Agent, or Firm* — Canon USA, Inc. I.P. Division

(57) ABSTRACT

To notify a residual life of a replaceable part at appropriate time on image quality required by the user. An image forming apparatus including: a replaceable part used for image formation; an output unit configured to output information indicating that a usage amount has reached a threshold; an input unit configured to input information; and a control unit configured to change the threshold in accordance with information about image quality input by the input unit.

10 Claims, 6 Drawing Sheets

IMAGE FORMING APPARATUS AND IMAGE FORMING SYSTEM

TECHNICAL FIELD

The present invention relates to an image forming apparatus, such as a copier and a printer.

BACKGROUND ART

An electrophotographic image forming apparatus consists mainly of a unit provided with a photoconductive drum, a developing apparatus, a transfer apparatus, a heating (i.e., fixing) apparatus, and the like. Depending on a configuration of the image forming apparatus, a usage amount is previously set for each of these unit and apparatuses as replaceable parts. When these unit and apparatuses reaches the end of their remaining lives, they may be replaced. For example, a process cartridge provided with a photoconductive drum, a developing apparatus and the like is replaceable as a consumable supply. A transfer apparatus, a heating apparatus, a feed roller and the like may also be set to be replaceable as replaceable parts.

In an image forming apparatus, it is important to properly set a remaining live of a replaceable part, to inform a user that an end of the residual life is approaching based on a residual life prediction result (i.e., a prediction result of a usage amount) and to inform the user that the replaceable part has reached the end of the residual life.

A heating apparatus will be described as an exemplary replaceable part. As a heating apparatus for heating and fixing an image transferred to a recording material, there has been a configuration provided with a heat roller as a heating member maintained at a predetermined temperature and a pressure roller as a pressurizing member pressed against the heat roller. This configuration is called a heat roller system in which a recording material as a to-be-heated material is introduced in a nip portion formed by the heat roller and the pressure roller and conveyed in a nipped manner while being heated.

Other than the heat roller system, there is a configuration in which a heater as a heat source and a heat-resistant film (hereafter, referred to as a film) as a flexible endless belt that is conveyed while being disposed opposite to and pressed against the heater and a support (also referred to as a stay) of the heater are used. This configuration is further provided with a pressure roller as a pressurizing member that makes the recording material as a to-be-heated material be in close contact with the heater via the film. This configuration is called film heating system in which a non-fixed image formed and supported on a surface of the recording material is fixed by heat to the surface of the recording material by applying heat of the heater to the recording material via the film.

Whether such a heating apparatus has reached the end of its residual life can be determined by determining whether the number of sheets of the recording materials that have passed the heating apparatus, a cumulative value of driving time (i.e., rotation time) of the heating apparatus, and the like have become equal to or greater than previously set thresholds. As methods for accurately predicting a residual life of a heating apparatus, a method for cumulating a rotation time while weighting in accordance with a temperature of a heating apparatus (see PTL 1) and a method for cumulating the number of passed sheets while weighting in accordance with a passing state of a recording material (see PTL 2) have been proposed.

CITATION LIST

Patent Literature

PTL 1: Japanese Patent Laid-Open No. 2005-115221
PTL 2: Japanese Patent Laid-Open No. 2000-131978

SUMMARY OF INVENTION

Technical Problem

A residual life of a replaceable part described above can be determined by determining whether a parameter of a usage amount thereof is equal to or greater than a set threshold (e.g., in a case of a heating apparatus, the parameter is the number of passed sheets, a cumulative value of rotation time, and the like). The threshold is set in advance in consideration of a range in which image quality, the conveying ability of a recording material, and the like can be satisfied based on a result of a durability test of the replaceable part.

Typically, image quality refers to as quality of a graphic image. The graphic image is an image which includes a half tone used when a photograph, a graph and the like are printed. As the replaceable part deteriorates over time, quality of the graphic image is reduced. For example, in a case of a heating apparatus of a film heating system, as the heating apparatus deteriorates over time, a surface layer of a film or a surface layer of a pressure roller wears out and deteriorates, and the surface layers are locally damaged and the like. Then, total or partial poor fixing may occur and quality of the graphic image is reduced.

Therefore, if the heating apparatus will be described as an exemplary replaceable part, as the heating apparatus deteriorates over time and quality of the graphic image is reduced, it is determined that the heating apparatus has reached its end of the residual life and a threshold is set through experiments on parameter values at that time, such as the number of passed sheets, and the cumulative value of rotation time.

Required image quality levels vary depending on users: some users require graphic image quality as described above while other users may accept reduction in quality of a graphic image if quality of a text image, such as characters, is satisfactory. Some other users may even accept reduction in quality of the text image.

For example, in a case in which the heating apparatus will be described as an example, even if the heating apparatus deteriorates over time and quality of the graphic image is reduced, the reduction in quality is caused by total or partial poor fixing. Therefore, in a text image with a print rate lower than that of a graphic image and in which poor fixing is less easily caused, quality of the image is maintained in many cases. That is, a residual life of a heating apparatus with satisfactory quality of text image is longer than a residual life of a heating apparatus with satisfactory quality of a graphic image.

When the heating apparatus further deteriorates over time, poor fixing becomes remarkable also in the text image and the quality thereof becomes unsatisfactory. However, the conveying ability of the recording material in the heating apparatus at the time is not reduced and conveyance of the recording material does not become impossible. For example, in a heating apparatus of a film heating system, it is common to apply a highly heat resistant lubricant on a surface of a heater (i.e., an inner surface of the film) in order to secure slidability of the film.

When the lubricant is exhausted as the heating apparatus deteriorates over time and it becomes impossible to secure slidability of the film, the heating apparatus causes poor conveyance of the recording material for the first time. The time at which conveying ability of the recording material becomes unsatisfactory is typically later than the time at which quality of a text image becomes unsatisfactory. That is, a residual life of a heating apparatus which satisfies conveying ability of a recording material is longer than a residual life of a heating apparatus which satisfies quality of a text image.

As described above, although a residual life of a heating apparatus depends on a quality level required by or accepted by a user, the residual life has been uniformly set in accordance with a reference of satisfying quality of, for example, a graphic image. Therefore, for a user who outputs many graphic image, the set residual life is appropriate. However, for a user for whom it is enough that quality of a text image is satisfied and for a user for whom that some defects in a text image cause no problem, the end of the residual life will be notified at an early time.

In the foregoing, although a heating apparatus will be described as an exemplary replaceable part, the same problem occurs in setting remaining lives of other replaceable parts.

The present invention provides an image forming apparatus capable of notifying a user a residual life of a replaceable part to user at more appropriate time depending on image quality required by the user.

Solution to Problem

An image forming apparatus of the present invention includes: a replaceable part used for image formation; an output unit configured to output information indicating that a usage amount of the replaceable part has reached a threshold; an input unit configured to input information; and a control unit configured to set the threshold in accordance with information about image quality input by the input unit.

An image forming system of the present invention includes an image forming apparatus and an input device connected to the image forming apparatus, in which the system includes: a replaceable part used for image formation; an output unit configured to output information indicating that a usage amount of the replaceable part has reached a threshold; and a control unit configured to set the threshold in accordance with information about image quality input by the input device.

Advantageous Effects of Invention

According to the present invention, a user can be notified of a residual life of a replaceable part at appropriate time depending on image quality required by the user.

DESCRIPTION OF EMBODIMENTS

Next, a specific configuration of the present invention for solving the problem described above will be described with reference to embodiments. The embodiments described hereinafter are illustrative only and the technical scope of the present invention is not limited to the same.

First Embodiment

Hereinafter, a first embodiment of the present invention will be described with reference to the drawings.

(1) Image Forming Apparatus

Figure 2A:
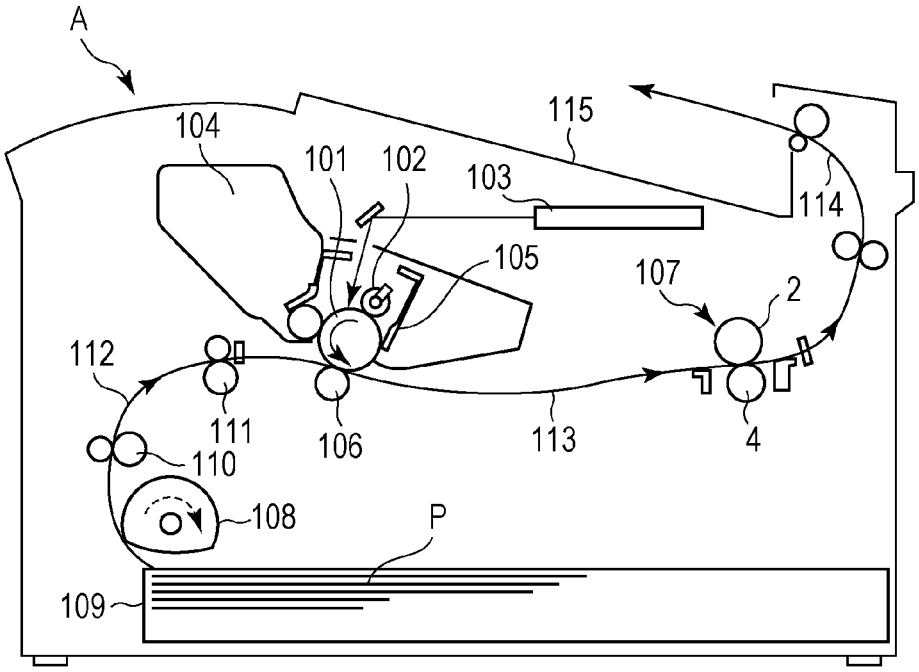
FIG. 2A is a schematic configuration diagram illustrating a main part of an image forming apparatus of the present invention.

FIG. 2A is a schematic configuration diagram of an image forming apparatus A of the present embodiment. The image forming apparatus A of the present embodiment is a laser printer as an electrophotographic printer. In the image forming apparatus A of the present embodiment, the maximum size of paper that can be passed through the apparatus is A4 size (paper width: 210 mm).

The reference numeral 101 denotes a photoconductive drum as an image bearing member, which is driven to rotate counterclockwise at a predetermined peripheral speed (referred also to as a process speed) as illustrated by an arrow. In the laser printer of the present embodiment, the process speed is set to 300 mm/sec.

The reference numeral 102 denotes a charging roller as a charging unit which is in contact with the photoconductive drum. The charging unit uniformly charges a surface of the photoconductive drum 101 to a predetermined polarity and a predetermined potential (referred also to primary charging).

The reference numeral 103 denotes a laser scanner as a latent image forming unit which forms an electrostatic latent image on the surface of the photosensitive member. The laser scanner outputs laser light which has been on-off modulated based on pixel signals corresponding to image information input from an image scanner and an external device a computer and the like which are not illustrated. The output laser light illuminates the photoconductive drum 101 and scan-exposes the charged surface of the photoconductive drum 101. This scanning exposure removes the charge of the exposed portion on the surface of the photoconductive drum 101 and an electrostatic latent image corresponding to the image information is formed on a surface of the photoconductive drum 101.

The reference numeral 104 denotes a developing apparatus. A developer (i.e., toner) is supplied to the electrostatic latent image formed on the photoconductive drum 101 from a developing roller as a development member, and is developed as a toner image. In a case of the laser printer of the present embodiment, a reversal development system in which toner is applied to an exposed portion of the electrostatic latent image and is developed is used.

The reference numeral 109 denotes a paper feeding cassette in which recording materials P are stored in a stacked manner. A feed roller 108 is driven in accordance with signals that instruct start of feeding, and the recording material P in the paper feeding cassette 109 is fed one at a time. The fed recording material P is conveyed by a conveying roller 110 and a resist roller 111, conveyed in a conveying path 112, and then introduced in a transfer region at a predetermined timing. The transfer region is a contact nip portion formed by the photoconductive drum 101 and a transfer roller 106 as a transfer member which is rotated in contact with the photoconductive drum 101. That is, conveying timing of the recording material P is controlled by the resist roller 111 such that, when a leading end of a toner image on the photoconductive drum 101 arrives at the transfer region, a leading end of the recording material P arrives at the transfer region.

The recording material P conveyed to the transfer roller 106 is conveyed while being nipped by the photoconductive drum 101 and the transfer roller 106 and, in that state, a transfer voltage (also referred to as a transfer bias) controlled to a predetermined voltage from an unillustrated transfer power supply is applied to the transfer roller 106. The transfer roller 106 as the transfer member and the control of the transfer voltage will be described later. A transfer bias of a polarity opposite to the polarity of the charge applied to the toner is applied to the transfer roller 106 and, thereby, the toner image on the photoconductive drum 101 is electrostatically transferred to a surface of the recording material P. The recording material P to which the toner image has been transferred is separated from the photoconductive drum 101, conveyed through a sheet path 113, and conveyed to a heating apparatus 107, where the recording material P is heated and pressurized. After the recording material P is separated (i.e., after the toner image is transferred to the recording material P), toner that has not successfully been transferred or debris exist on the surface of the photoconductive drum 101. These toner and debris are removed by a cleaning device 105. The recording material P which has passed through the heating apparatus 107 is conveyed in a sheet path 114 and discharged through a discharge port onto an output tray 115.

In the present embodiment, the photoconductive drum 101, the charging roller 102, the developing apparatus 104 and the cleaning device 105 constitute a process cartridge as a unitized image forming unit. This process cartridge is detachably attached to the laser printer. For example, when the toner in the developing apparatus 104 is run out, a user can replace the process cartridge.

Typically, as the transfer roller 106 as the transfer member, an elastic sponge roller is used. The elastic sponge roller is fabricated by a core metal and a semi-conductive sponge elastic layer of a carbon, ion conductive filler, and the like formed thereon of which resistance is adjusted to about $1\times10^6$ ohms to $1\times10^{10}$ ohms. In the present embodiment, an ion conductive transfer roller is used. The transfer roller consists of a core metal and a roll-shaped conductive layer formed coaxially with and on the outer periphery of the core metal formed by reacting NBR rubber, a surfactant and the like. The resistance value is in the range of $1\times10^8$ ohms to $5\times10^8$ ohms.

Figure 2B:
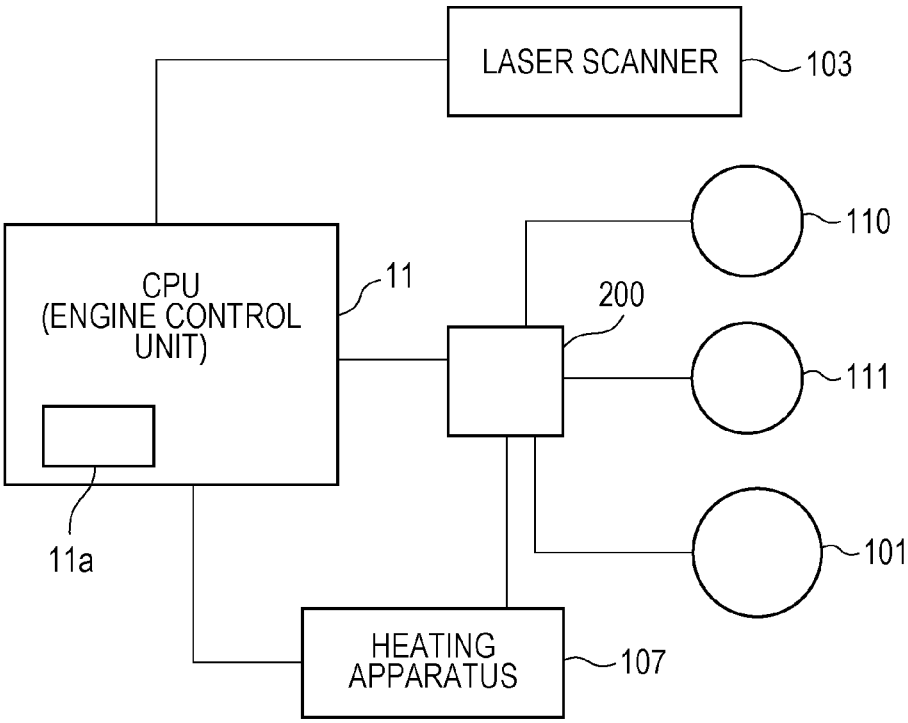
FIG. 2B is a block diagram illustrating a connection relationship between a CPU which controls the image forming apparatus and each unit.

FIG. 2B is a schematic block diagram illustrating a connecting relationship of a CPU 11 which controls the image forming apparatus A and each part. The CPU 11 instructs the laser scanner 103 to be driven and forms an electrostatic latent image on the photoconductive drum 101. The CPU 11 drives a motor 200 to drive the conveying roller 110, the resist roller 111 and the photoconductive drum 101 to rotate. Therefore, the recording material P is conveyed to the conveying path 112, and then an image is formed. When the motor 200 is driven, the heating apparatus 107 is also driven. Driving control of the heating apparatus 107 is also performed in accordance with an instruction from the CPU 110. Details of the heating apparatus 107 will be described later. A ROM 11*a* as a storage element is provided in the CPU 11. A program for executing the control based on a later-described flowchart is stored in the ROM 11*a* in advance.

(2) Configuration of Heating Apparatus 107

Figure 3:
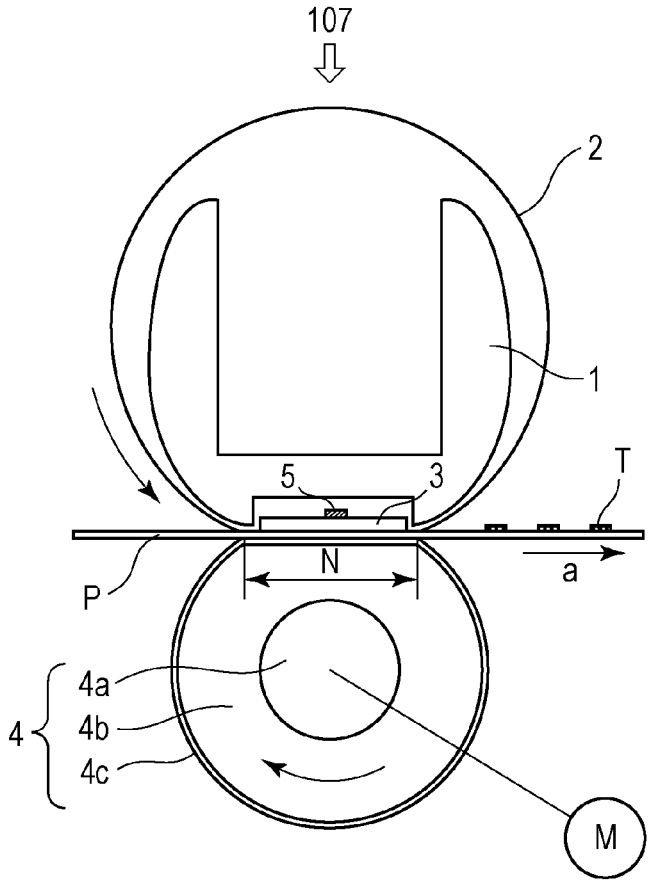
FIG. 3 is a schematic configuration diagram illustrating a main part of a heating apparatus of the present invention.

Next, the heating apparatus 107 in the present embodiment will be described. In the present embodiment, a heating apparatus of a film heating system is employed. FIG. 3 is a schematic configuration diagram of the heating apparatus of the film heating system of the present embodiment. This apparatus is a tensionless apparatus which is a well-known configuration.

The heating apparatus of the tensionless film heating system includes a heat-resistant film of an endless belt shape or a cylindrical shape. At least a part of a perimeter of the heat-resistant film is always in a tension free state (i.e., a state in which no tension is applied) and the film is driven to rotate by rotational driving force of a pressurizing member.

The reference numeral 1 denotes a stay which is a member having heat resistance and rigidity as a heater holding member and a film guide member. The reference numeral 3 denotes a ceramic heater as a heating member which is supported at a lower portion of the stay 1 and disposed along a longitudinal direction of the stay 1. The stay 1 which is an endless (i.e., cylindrical) heat-resistant film and is fit onto the stay 1, from outside, which is a film guide member including the heater 3. An inner peripheral length of the endless heat-resistant film 2 is longer than an outer peripheral length of the stay 1 including the heater 3 by, for example, about 3 mm and, therefore, the film 2 is fit onto the stay 1 from outside with an extra length in the perimeter. In order to secure slidability of the film 2, a highly heat resistant lubricant (i.e., grease) is applied to a surface of the heater 3 in the present embodiment.

The stay 1 may be made of, for example, highly heat resistant resin such as polyimide, polyamidoimide, PEEK, PPS and liquid crystal polymer, and a composite material of the resin listed above and ceramic, metal, glass and the like. Liquid crystal polymer is used in the present embodiment.

In order to improve quick start property by reducing heat capacity, the film 2 may be made of a heat resistant single layer film, such as PTFE, PFA and FEP, of which thickness is equal to or smaller than 100 micrometers, and preferably is equal to or smaller than 50 micrometers and equal to or greater than 20 micrometers, or a composite layer film consisting of a film, such as polyimide, polyamidoimide, PEEK, PES and PPS, of which outer peripheral surface is coated with PTFE, PFA, FEP and the like. In the present embodiment, an about 50 micrometer-thick polyimide film of which outer peripheral surface is coated with PTFE is used. An outer diameter of the film 2 is set to 30 mm.

The reference numeral 4 denotes a pressure roller as a film outer surface contact driving unit which forms a pressure contact nip portion (fixing nip portion) N with the heater 3 which nips the film 2 therebetween and drives the film 2 to rotate. The pressure roller 4 consists of a core metal 4*a*, an elastic body layer 4*b* and an outermost mold releasing layer 4*c*. The pressure roller 4 is disposed such that the film 2 is nipped by using an unillustrated bearing unit and an urging unit at predetermined pressure and is pressed against a surface of the heater 3. In the present embodiment, an aluminum core metal is used as the core metal 4*a*, silicone rubber is used as the elastic body layer 4*b* and an about 50 micrometer-thick PFA tube is used as the mold releasing layer 4*c*. An outer diameter of the pressure roller 4 is set to 24 mm and a thickness of the elastic body layer 4*b* is set to about 3 mm.

The pressure roller 4 is rotated clockwise as illustrated by an arrow at a predetermined peripheral speed by a motor M which is a driving unit. When the pressure roller 4 is driven to rotate, rotational force acts on the film 2 by frictional force between the pressure roller 4 and an outer surface of the film 2 in the pressure contact nip portion N. The film 2 is driven to rotate counterclockwise as illustrated by an arrow at substantially the same peripheral speed as a rotary peripheral speed of the pressure roller 4 with an inner surface side of the film 2 being in close contact with the surface of the heater 3 and sliding in the fixing nip portion N.

Figure 4:
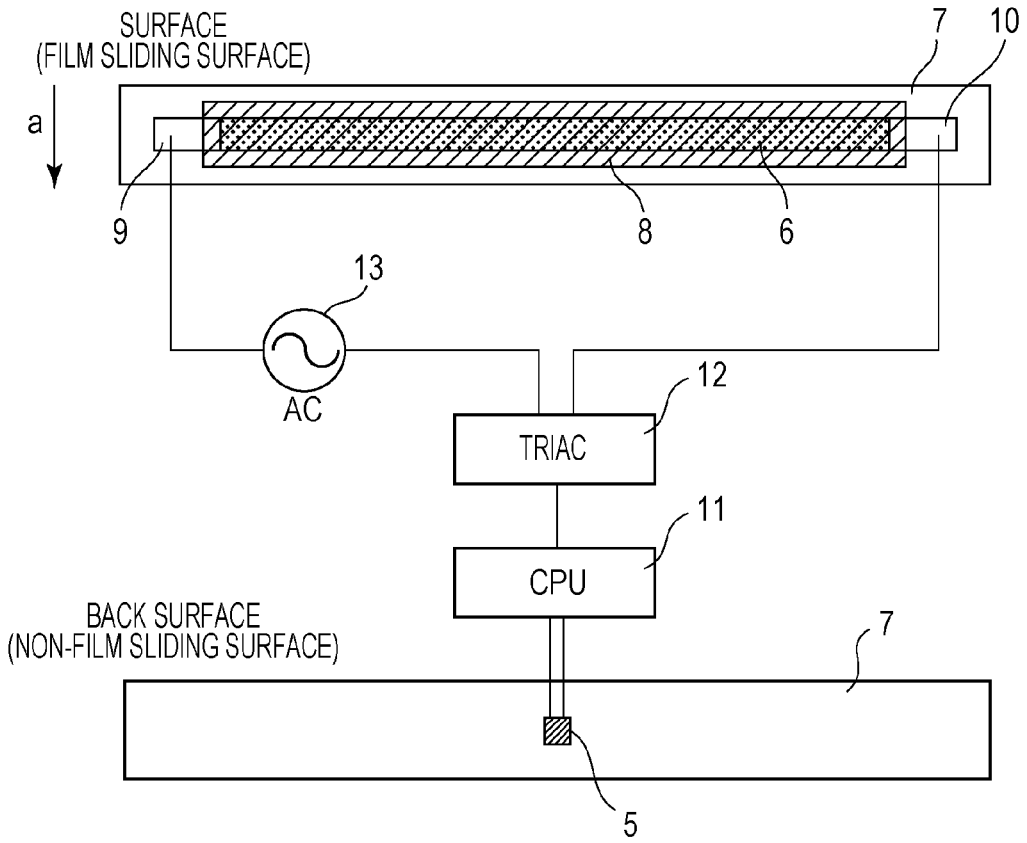
FIG. 4 is a front view of a heater and a diagram of an energizing control circuit of the heater of the present invention.
Figure 5:
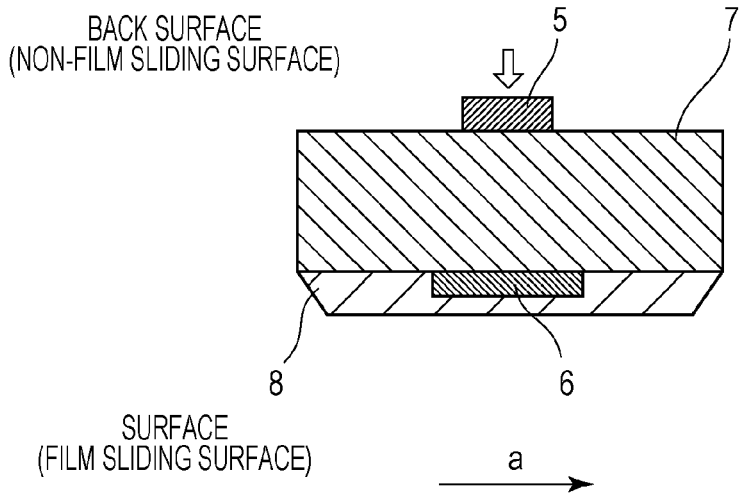
FIG. 5 is a cross-sectional view of the heater of the present invention.

Next, the heater 3 of the present embodiment will be described. FIG. 4 is a front view of the heater 3 and a circuit diagram for energization control of the heater 3 in the present embodiment. FIG. 5 is a cross-sectional view of the heater 3 in the present embodiment.

The heater 3 has an elongated shape with its longitudinal direction extending in a right angle direction with respect to the conveyance direction a of the recording material P as the to-be-heated material. The heater 3 consists of a heat resistant, insulating and highly thermal conductive substrate 7, a heating resistor 6 formed on a front surface (i.e., film sliding surface) side of the substrate 7, a heat-resistant overcoat layer 8 protecting a surface of the heater on which the heating resistor 6 is formed, and power feeding electrodes 9 and 10 disposed at both end portions in a longitudinal direction of the heating resistor 6. The heater 3 is an entirely low heat capacity heater.

The heating resistor 6 of the present embodiment is provided by screen-printing, on the substrate 7, a paste obtained by kneading Ag palladium, glass powder (i.e., an inorganic binder) and an organic binder.

The reference numeral 7 denotes a heat resistant and insulating heater substrate which is made of, for example, a ceramic material, such as aluminum oxide and aluminum nitride.

The reference numeral 8 denotes an overcoat layer of the heating resistor 6 which is provided to secure electrical insulation between the heating resistor 6 and the surface of the heater 3 and to secure the slidability of the film 2. In the present embodiment, a heat resistant glass layer is used as the overcoat layer 8.

A silver screen-printing pattern is used for the power feeding electrodes 9 and 10. Since the power feeding electrodes 9 and 10 are provided in order to feed power to the heating resistor 6, resistance of the power feeding electrodes 9 and 10 is set to be sufficiently low as compared with that of the heating resistor 6.

The reference numeral 5 is a thermometric element provided to detect a temperature of the heater 3. In the present embodiment, an external contact type thermistor separated from the heater 3 is used as the thermometric element. This external contact type thermistor 5 is configured such that, for example, a heat insulating layer is provided on a support and an element of a chip thermistor is fixed thereon and, the element is made to contact with a back surface of the heater with predetermined pressure force with the element facing downward (i.e., the back surface of the heater side). In the present embodiment, highly heat resistant liquid crystal polymer is used as a support and ceramic paper is laminated as a heat insulating layer. The external contact type thermistor 5 is connected to the CPU 11. The heater 3 described above is disposed to be fixed with the front surface side on which the heating resistor 6 and the overcoat layer 8 are formed facing downward and exposed, and supported at the lower portion of the stay 1.

The temperature of the heater 3 is increased when power is supplied from the power feeding electrodes 9 and 10 at the both end portions of the heating resistor 6 in the longitudinal direction and the heating resistor 6 is heated along its entire length. The temperature is detected by the thermistor 5, output of the thermistor 5 is A/D converted and taken in the CPU 11, the power to be supplied to the heating resistor 6 is controlled by a triac 12 in accordance with the taken information and, therefore, temperature control of the heater 3 is performed. That is, the temperature of the heater 3 is kept to be constant by controlling the power so that the temperature of the heater 3 is increased when the temperature detected by the thermistor 5 is lower than a predetermined preset temperature and is lowered when temperature detected by the thermistor 5 is higher than a predetermined preset temperature. This preset temperature is referred to as a fixing temperature.

In a state in which the temperature of the heater 3 is increased a predetermined temperature and the rotary peripheral speed of the film 2 by the rotation of the pressure roller 4 is stable, the recording material P is conveyed to the pressure contact nip portion N formed by the heater 3 and the pressure roller 4 with the film 2 disposed therebetween. The recording material P is conveyed in the pressure contact nip portion N in a nipped manner together with the film 2 and the heat of the heater 3 is applied to the recording material P via the film 2. Therefore, a toner image T transferred to the recording material P is fixed to the recording material P by heat. The recording material P which has passed through the pressure contact nip portion N is conveyed to separate from the film 2 and is discharged outside of the apparatus.

(3) Method for Determining End of Remaining Life of Replaceable Part in Present Embodiment In the present embodiment, the process cartridge, the transfer roller 106, the heating apparatus 107 and the feed roller 108 described above are detachably attached to a main body of the laser printer so as to be replaced by a user or a serviceperson and are set as replaceable parts. Hereinafter, in the present embodiment, regarding the heating apparatus 107 as an exemplary replaceable part, a mechanism of determination of an end of a residual life and notification will be described.

In the present embodiment, a cumulative value of rotation time of the heating apparatus is used as a parameter for determining whether the heating apparatus 107 has reached an end of its residual life. When the film 2 and the pressure roller 4 of the heating apparatus 107 rotate during a printing operation, rotation time is counted and a cumulative value of the rotation time is stored in an unillustrated memory of the CPU 11. Whether the heating apparatus 107 has reached the end of its residual life is determined by determining whether the cumulative value of the rotation time is equal to or greater than a predetermined value (hereafter, referred to as a threshold) which is set in advance.

Although the cumulative value of the rotation time is used as the parameter in the present embodiment, a cumulative value of the number of passed sheets or a cumulative value of the number of times of rotation of the film 2 and the pressure roller 4 may also be used as the parameter. Alternatively, these plurality of parameters may be cumulated independently and stored. In that case, when any of the parameters becomes equal to or greater than a predetermined value, it may be determined that the end of the residual life has come.

When the parameter is cumulated, it is also possible to weight depending on conditions, such as the ambient temperature and humidity of the image forming apparatus (for example, in a case in which an environment sensor and the like is provided), a process speed (in the case of an apparatus having a plurality of process speeds), paper size, paper type (a difference in basic weight and surface property) and a fixing temperature. For example, regarding the fixing temperature, typically a surface layer of the film and a surface layer of the pressure roller tend to wear and deteriorate easily as the fixing temperature is higher. In order to accurately predict the residual life in consideration of such a relationship between the fixing temperature and the wear, it may be effective to weight the rotation time to be added on the condition that the fixing temperature is set to be high (for example, rotation time to be added is increased 1.5 times).

Next, in the configuration of the heating apparatus 107 of the present embodiment, a durability test is performed to check a state and image quality of the heating apparatus 107. As a result, a cumulative value of the rotation time of the heating apparatus 107 with which quality of the graphic image is satisfactory is 200 hours. Therefore, the rotation time is cumulated from the beginning of the usage of the heating apparatus 107 and, when the cumulative value reaches 200 hours, it is determined that the heating apparatus has reached its end of the residual life (in a case in which the threshold to be determined as the end of the residual life has come has been set to 200 hours).

Note that this is the residual life of the heating apparatus 107 regarding the graphic image and, as described above, the residual life regarding a text image or the cumulative value (i.e., residual life) with which conveying ability of the recording material is satisfactory are longer than 200 hours. Although the residual life of the heating apparatus has been uniformly set to 200 hours irrespective of the quality acceptable by the user, the predetermined value determined as the end of the residual life is variable depending on the image quality that the user can accept in the present invention. A degree of image quality level which the user can accept is defined as a "print level" in the present invention. In the present embodiment, the print level is defined as follows. Print level 1: no defect exists in graphic images. Print level 2: no defect exists in text images (defects in the graphic images are accepted). Print level 3: some defects exist in text images (defects in text images are accepted). With the configuration of the heating apparatus 107 of the present embodiment, a durability test is performed to examine the rotation time (which is a threshold to be determined as the end of the residual life has come) of the heating apparatus with which each of the print level is satisfied. The result is shown in the following Table 1.

TABLE 1

| PRINT LEVELS | PREDETERMINED VALUES DETERMINED AS THE END OF THE RESIDUAL LIFE (THRESHOLDS) |
|---|---|
| 1 (NO DEFECT IN GRAPHIC IMAGE) | 200 HOURS |
| 2 (NO DEFECT IN TEXT IMAGE) | 300 HOURS |
| 3 (SOME DEFECTS IN TEXT IMAGE) | 400 HOURS |

As a cumulative usage amount of the heating apparatus 107 increases and the heating apparatus 107 deteriorates over time, a surface layer of the film 2 or a surface layer of the pressure roller 4 wears out and deteriorates, and the surface layers are locally damaged and the like. Therefore, an image defect resulting from such damage (i.e., total or partial poor fixing) occurs. From the result of the experiments, after the rotation time reaches 200 hours, image quality of the graphic image becomes unsatisfactory (i.e., non-fixed portions partially exist in the image). A print rate of a text image tends to be lower than that of a graphic image, and fixability of a text image tends to be higher than that of a graphic image. Therefore, until the heating apparatus 107 further deteriorates over time and the rotation time exceeds 300 hours, image quality of a text image is satisfactory. That is, the threshold to be determined as the end of the residual life has come in the print level 2 can be set to be higher than the threshold to be determined as the end of the residual life has come in the print level 1.

As the heating apparatus 107 further deteriorates over time and the rotation time exceeds 300 hours, image quality even of a text image becomes unsatisfactory. However, some users want to continue printing even after some defects occurred in the text image. In this case, as described above, the conveying ability of the recording material in the heating apparatus 107 does not necessarily become unsatisfactory at that time, but the recording material can be conveyed normally and printing can be continued. Therefore, the threshold to be determined as the end of the residual life has come in the print level 3 can be set to be higher than the threshold to be determined as the end of the residual life has come in the print level 2.

In the present embodiment, the user inputs information about the print level from an operation panel as an operation unit or a computer connected to the laser printer, and a threshold to be determined as the end of the residual life has come in accordance with Table 1 is set based on the input information.

Although the print level is set in accordance with the fixing state of the image by the heating apparatus 107 in the present embodiment as an example, this is not restrictive. For example, the print level may also be set in accordance with a frequency with which a jam occurs that the user can accept and the like. It is also possible to set the print level by correlating the image quality level not with the heating apparatus 107 but with the photoconductive drum of the process cartridge or the cumulative usage amount of the developing apparatus.

Figure 1:
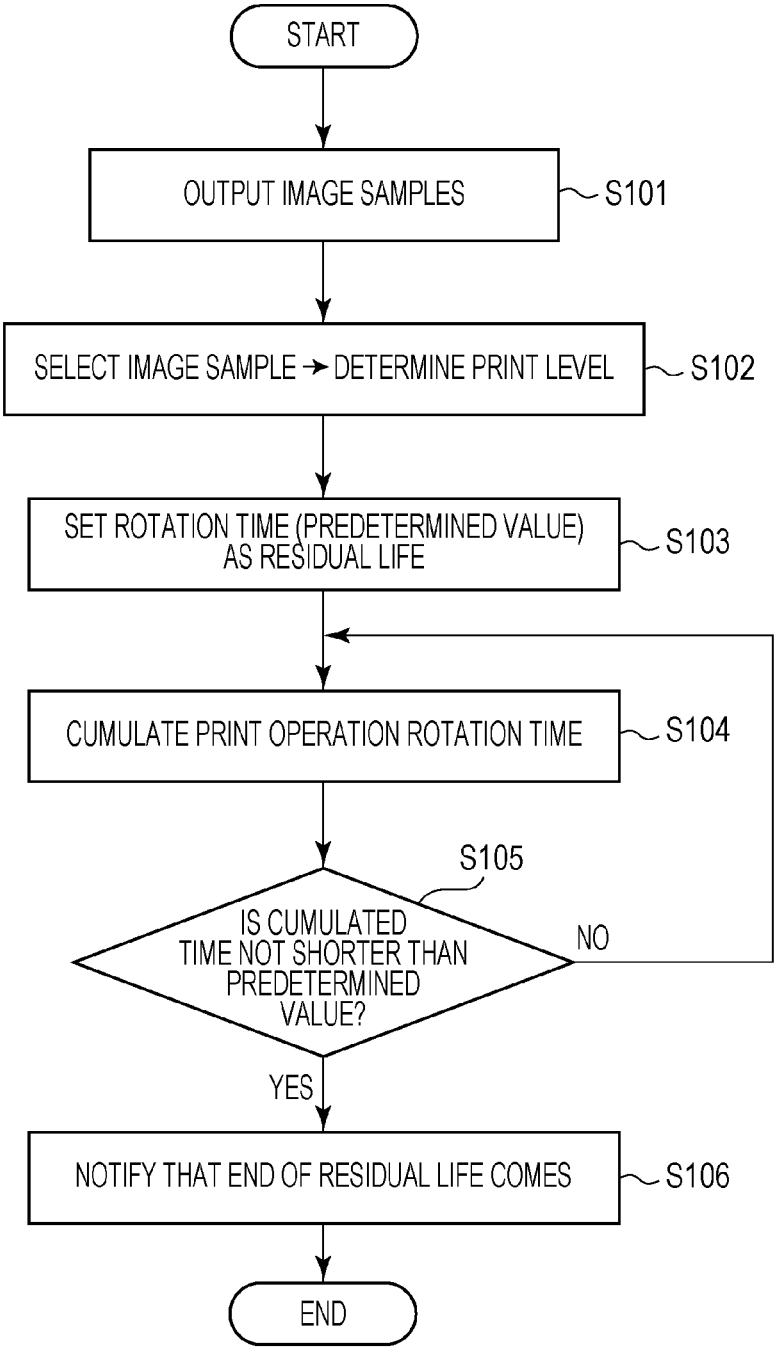
FIG. 1 is a flowchart illustrating a mechanism of notification of a residual life of a first embodiment.

Hereinafter, a mechanism of determination of an end of a residual life and notification of the present embodiment will be described with reference to a flowchart. FIG. 1 is a flowchart illustrating a mechanism of determination of an end of a residual life and notification of the heating apparatus 107 in the present embodiment.

First, when the image forming apparatus of the present embodiment arrives at the user's place and is put into a state in which an operation can be started, an image sample stored in advance is automatically output to a ROM as a storage unit of the image forming apparatus (step S101). In the present embodiment, three image samples are output automatically. In each of the three image samples, both the graphic image and the text image are printed on the same sheet. The first one is an image sample in which no defect exists in both images. The second one is an image sample in which a defect exists in the graphic image (for example, density is locally low) while no defect exists in the text image. The third one is an image sample in which defects exist in both images (for example, there is a partial lack of image in the text image). Although these image samples are examples and there is possibility that defects actually caused in the image after deterioration over time are not the same as those in these image samples, the image samples are experimentally created from the state of the defects caused in the image.

The user checks this three image samples, determines to which level of the samples is acceptable, and inputs the information in the image forming apparatus. The information to be input is the information about the selected image sample (i.e., the number 1 to 3). The information about the image sample may be input from a computer connected to the laser printer. The print level is determined based on the input information (step S102). The degree to which the user can accept among the three image samples corresponds to the print level to be set. The relationship is shown in Table 2.

TABLE 2

| | IMAGE SAMPLES ACCEPTED BY USER | | DETER- |
|---|---|---|---|
| INFORMATION INPUT BY USER | GRAPHIC IMAGE PORTION | TEXT IMAGE PORTION | MINED PRINT LEVEL |
| IMAGE SAMPLE 1 | NO DEFECT EXISTS | NO DEFECT EXISTS | 1 |
| IMAGE SAMPLE 2 | DEFECT EXISTS | NO DEFECT EXISTS | 2 |
| IMAGE SAMPLE 3 | DEFECT EXISTS | DEFECT EXISTS | 3 |

As an exemplary method for encouraging a user to determine and input of the information, for example, a message encouraging the user to determine and input of the information is output (i.e., displayed) on an operation panel provided in the image forming apparatus and the user inputs the information on the operation panel. In a case in which a computer used by the user is connected to the image forming apparatus, it is also possible to let the user check the image samples on a monitor of the computer and input the information.

After the print level is determined, the cumulative value (i.e., the threshold to be determined as the end of the residual life) of the rotation time determined as the residual life in accordance with Table 1 is set (step S103). Although the print level is determined in accordance with the information input by the user and the threshold corresponding to the input information is set in the present embodiment, it is also possible that, for example, a dealer who provides the user with the image forming apparatus grasps the user's status of use and sets the print level in advance before providing the image forming apparatus to the user.

After setting of the residual life of the heating apparatus 107 is completed, the rotation time of the heating apparatus 107 is cumulated and stored as the user uses the apparatus (step S104). It is also possible to weight as described above at the time of cumulation. Then the cumulative time is compared with the threshold set in accordance with the print level (step S105). If the cumulative time is smaller than the threshold, the process returns to step S104. If the cumulative time is equal to or greater than the threshold, the user is notified that the heating apparatus 107 has reached the end of the residual life and is encouraged to replace the heating apparatus (step S106).

For example, if the print level is 2, since the threshold to be determined as the end of the residual life is 300 hours. Then, the current cumulative time is set to X hours, the X hours is compared with 300 hours and, if X is smaller than 300, the process returns to step S104 and, if X is equal to or greater than 300, the process proceeds to step S106.

Determination of the residual life in step S105 may be performed constantly during the printing operation or may be performed at predetermined timing each time the printing job is completed. Notification of the residual life in step S106 is performed in the same manner. A message notifying the user that the end of the residual life has come may be displayed on the operation panel of the image forming apparatus or may be displayed on the monitor in a case in which a computer is connected. Alternatively the message may be output by printing.

Instead of calculating the residual life from the current cumulative time and the threshold and, thereafter, notifying that the end of the residual life has come, it is also possible, for example, to notify the user that the replacement time is approaching when the residual life becomes 10%.

In a case in which the user is encouraged to replace the heating apparatus 107 and the user actually replaced the heating apparatus 107, the cumulative time of the rotation time of the heating apparatus 107 is reset to 0 and the control after step S104 is performed. In order to detect that the heating apparatus 107 is actually replaced, the user or a serviceperson may be asked to input, in the image forming apparatus, information that replacement has been made or a mechanism capable of detecting that the heating apparatus 107 is new may be provided. As a mechanism capable of detecting that the heating apparatus 107 is new, an electrical method, such as a storage element (which detects using stored data), a fuse or the like may be used.

The print level may be set again by performing steps of outputting the image samples of step S101 and afterwards again at the timing at which the heating apparatus 107 is replaced with a new one.

As described above, with the control of the present embodiment, determination of the end of the residual life of the heating apparatus and notification can be performed at appropriate timing in accordance with the image quality acceptable by the user. Therefore, notification of the residual life in accordance with the user's request becomes possible as compared with uniform determination of the residual life and notification of the related art. For example, in the present embodiment, a user who selected the print level 2 receives notification of the residual life later than the time of uniform setting of the related art (i.e., the same setting as that of the print level 1) and can use the heating apparatus for a longer time.

Although the heating apparatus has been described as the replaceable part in the present embodiment, regarding the residual life of other replaceable parts, such as the process cartridge, the transfer apparatus and the feed roller, or the main body of the image forming apparatus, a mechanism in which the residual life is variable depending on the level that the user can accept as described in the present embodiment may also be applied.

Second Embodiment

In the first embodiment, the heating apparatus is described as an example of the replaceable part. In the present embodiment, an example in which a residual life is determined and notified independently for each of a plurality of replaceable parts will be described. In the present embodiment, a heating apparatus 107 and a transfer roller 106 will be described as examples of the plurality of replaceable parts. Since a configuration of an image forming apparatus A of the present embodiment is the same as that of the first embodiment, description thereof will be omitted.

In the present embodiment, a cumulative value of rotation time of a transfer roller is used as a parameter for determining whether the transfer roller 106 has reached an end of a residual life. When the transfer roller 106 rotates during the printing operation, the rotation time is counted and the cumulative value is stored in the CPU 11. This cumulative value is stored separately from the cumulative value of the rotation time of the heating apparatus 107. Then, whether the transfer roller 106 has reached an end of its residual life is determined by determining whether the cumulative value of the rotation time has become equal to or greater than a predetermined value (hereafter, referred also to as a threshold).

Although the cumulative value of the rotation time is used as the parameter in the present embodiment, a cumulative value of the number of passed sheets and a cumulative value of the number of times of rotation of the transfer roller 106 may also be used as parameters. These plurality of parameters may be cumulated independently in parallel and are stored and, when any one of the parameters exceeds a threshold, it may be determined that an end of a residual life has come.

When the parameter is cumulated, it is also possible to weight depending on conditions, such as the ambient temperature and humidity of the image forming apparatus (for example, in a case in which an environment sensor and the like is provided), a process speed (in the case of an apparatus having a plurality of process speeds), paper size and paper type. The paper type here means recording materials different in basic weight and surface property. For example, the recording materials different in types, such as regular paper, cardboard, thin paper, gross paper and rough paper, are exemplified. A concept about cumulation of parameters of the transfer roller 106 in the present embodiment is the same as the concept about the parameter cumulation of the heating apparatus described in the first embodiment. Therefore, similarly to the first embodiment, the print levels are set in the following manner in the present embodiment. A residual life corresponding to each print level is also set to the transfer roller 106. Print level 1: no defect exists in graphic images. Print level 2: no defect exists in text images (defects in the graphic images are accepted). Print level 3: some defects exist in text images (defects in text images are accepted). With the configuration of the transfer roller of the present embodiment, a durability test and the like are performed to examine the rotation time (which is a predetermined value determined as the end of the residual life) of the transfer roller with which each of the print level is satisfied. The result is shown in Table 3.

TABLE 3

| INFORMATION INPUT BY USER | PRINT LEVELS | PREDETERMINED VALUES DETERMINED AS THE END OF THE RESIDUAL LIFE (THRESHOLDS) |
|---|---|---|
| IMAGE SAMPLE 1 | 1 (NO DEFECT IN GRAPHIC IMAGE) | 250 HOURS |
| IMAGE SAMPLE 2 | 2 (NO DEFECT IN TEXT IMAGE) | 350 HOURS |
| IMAGE SAMPLE 3 | 3 (DEFECT EXISTS IN TEXT IMAGE) | 500 HOURS |

Typically, as the transfer roller deteriorates over time, electrical resistance of an elastic layer increases and, when a certain threshold is exceeded, it becomes impossible to provide enough charge for holding toner on the recording material and it becomes impossible to satisfy transferability. In particular, the following defects are caused: printing density in a graphic image becomes insufficient; or a text image becomes unclear due to toner scattering in an area other than a printing area. Since a print rate of the graphic image is higher than that of the text image and, therefore, higher transferability is required in the graphic image than in the text image, defects in the graphic image is caused earlier than defects in the text image as illustrated in Table 3. As the transfer roller further deteriorates over time, a surface of the transfer roller wears and deteriorates, and a defect begins to occur in conveying ability of the recording material.

In the present embodiment, the user is asked to input information about the print level and a predetermined value determined as the end of the residual life for the heating apparatus is set in accordance with Table 1 described in the first embodiment, and a predetermined value determined as the end of the residual life for the transfer roller is set in accordance with Table 3, independently. As is seen from the comparison between Table 1 (the first embodiment) and Table 3, the threshold to be determined as the end of the remaining life of the heating apparatus 107 and the threshold to be determined as the end of the remaining life of the transfer roller 106 are different values. From this, it is understood that the residual life of the replaceable part depends on the configuration (i.e., a material) thereof. That is, this also applies to the replaceable parts other than the heating apparatus and the transfer roller (for example, the process cartridge, the feed roller and the like). Of course, different replaceable parts may sometimes have the same threshold.

Figure 6:
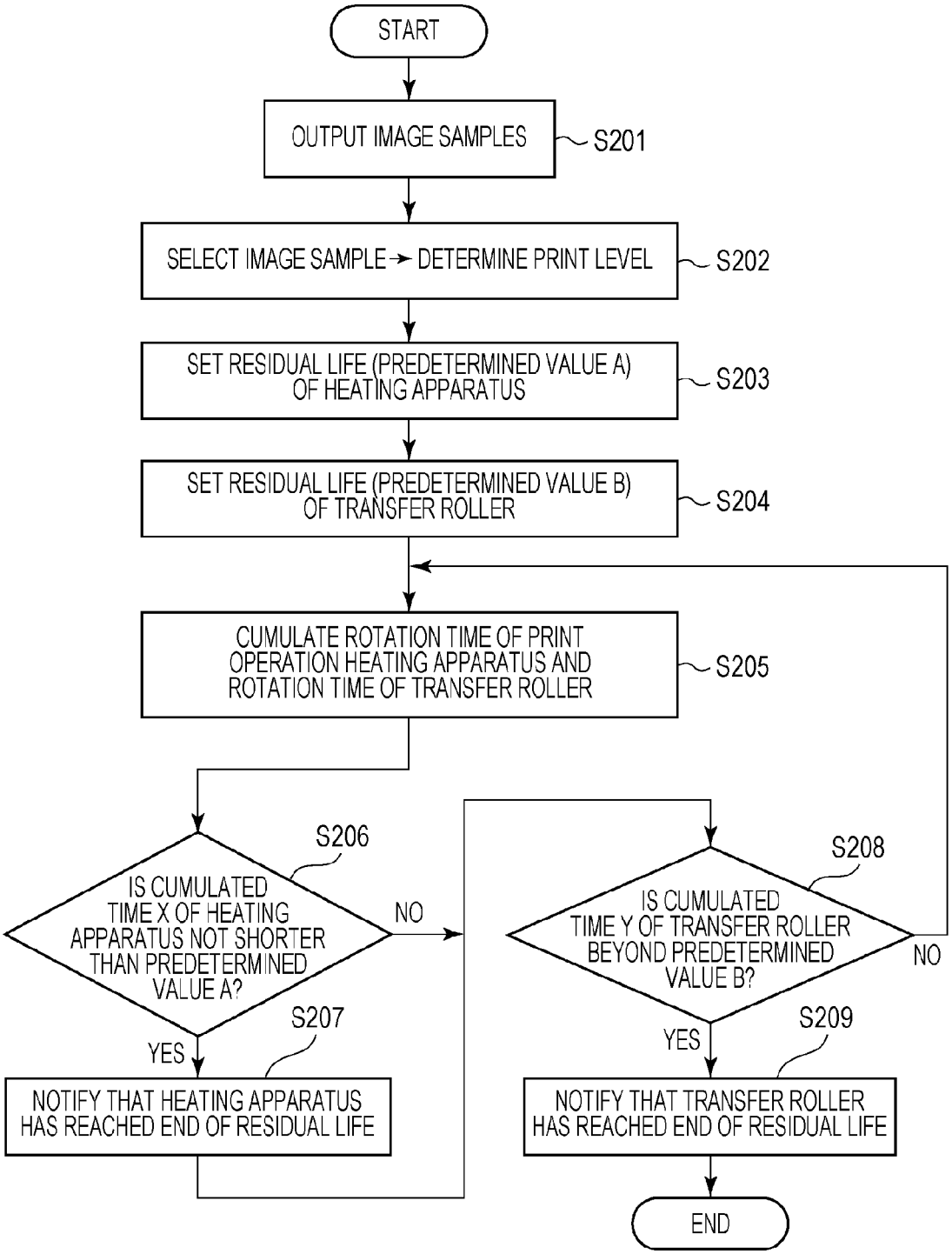
FIG. 6 is a flowchart illustrating a mechanism of notification of a residual life of a second embodiment.

Hereinafter, a mechanism of determination of an end of a residual life and notification of the present embodiment will be described with reference to a flowchart. FIG. 6 is a flowchart illustrating a mechanism of determination of an end of a residual life and notification of the heating apparatus and the transfer roller in the present embodiment.

Steps S201 and S202 of FIG. 6 are the same as the configuration of FIG. 1 of the first embodiment. Here, similarly to the first embodiment, the user is asked to select an acceptable image sample and input information and a print level is determined depending on the information (Table 2 of the first embodiment is used).

After the print level is determined, in accordance with Table 1, the rotation time of the heating apparatus (i.e., the predetermined value determined as the end of the residual life) determined as the residual life is set (step S203). The threshold to be determined as the end of the remaining life of the heating apparatus is set to A hours. Next, in accordance with Table 3, the rotation time (which is the predetermined value determined as the end of the residual life) of the transfer roller determined as the residual life is set (step S204). The threshold to be determined as the end of the remaining life of the transfer roller is set to B hours.

In the present embodiment, the print level is determined and a predetermined value A of the heating apparatus and a predetermined value B of the transfer roller are set in accordance with the print level. However, the print level may also be determined by outputting image samples of each of the replaceable parts and asking the user to select and input acceptable image samples.

Although the print level is determined in accordance with the information input by the user and the threshold corresponding to the input information is set in the present embodiment, it is also possible that, for example, a dealer who provides the user with the image forming apparatus grasps the user's status of use and sets the print level in advance before providing the image forming apparatus to the user. Further, a selective method in which, for example, a dealer sets the print level of the heating apparatus in advance and the print level of the transfer roller is determined in accordance with information selected by a user may also be used.

After setting of the residual life of the heating apparatus 107 and the residual life of the transfer roller 106 are completed, the rotation time of the heating apparatus 107 and the rotation time of the transfer roller 107 are each cumulated and stored as the user uses the apparatus (step S205). The current cumulative time of the heating apparatus 107 is set to X hours, the current cumulative time of the transfer roller 106 is set to Y hours, and cumulation is performed separately. It is also possible to weight as described above at the time of cumulation. When weighting is performed, since the condition under which weighting is performed and the weighting value may sometimes differ between in the heating apparatus 107 and in the transfer roller 106, the X hours and the Y hours are different values from each other. In a case in which weighting is not performed, however, if a unit to drive the heating apparatus 107 (i.e., a motor) and a unit to drive the transfer roller 106 (i.e., a motor) are provided separately, the rotation time of the heating apparatus 107 and the rotation time of the transfer roller 106 are different from each other during the printing operation. Therefore, the X hours and the Y hours are different values from each other. Of course, in a configuration in which the X hours and the Y hours are always the same value, it is not necessary to use different variables and the same variable may be used and managed.

Next, the current cumulative time X of the heating apparatus 107 is compared with a threshold A which is set in accordance with the print level (step S206). If X is smaller than A, the process proceeds to step S208. If X is equal to or greater than A, it is determined that the heating apparatus has reached its end of the residual life, and the user is notified that the heating apparatus has reached its end of the residual life and is encouraged to replace the heating apparatus (step S207). After the notification that the heating apparatus has reached the end of the residual life is made, the process proceeds to step S208.

In step S208, the residual life of the transfer roller 106 is determined. The current cumulative time Y of the transfer roller is compared with a predetermined value V which is set in accordance with the print level. If Y is smaller than B, the process returns to step S205. If Y is equal to or greater than B, it is determined that the transfer roller 106 has reached its end of the residual life, and the user is notified that the transfer roller has reached its end of the residual life and is encouraged to replace the transfer roller (step S209).

In a case in which the user is encouraged to replace the heating apparatus and the transfer roller and the user actually replaced the heating apparatus and the transfer roller, the cumulative time (X or Y) of the replaced replaceable part is reset to 0 and the control step S205 and thereafter is performed.

As described above, with the control of the present embodiment, determination of the end of the residual life of the heating apparatus and the transfer roller and notification can be performed at appropriate timing for each of the heating apparatus and the transfer roller in accordance with the image quality acceptable by the user. Therefore, some users receive notification of the residual life later than the time of uniform notification of the residual life of the related art and can use the heating apparatus and the transfer roller more efficiently.

Although a case in which the residual life management of the two replaceable parts, i.e., the heating apparatus and the transfer roller, is performed independently is described in the present embodiment, it is also possible to perform residual life management of three or more replaceable parts including the process cartridge, the feed roller and the like, independently. It is also possible to manage not only the residual lives of the replaceable parts but also the residual life of the image forming apparatus itself.

Other Embodiments

Figure 7:
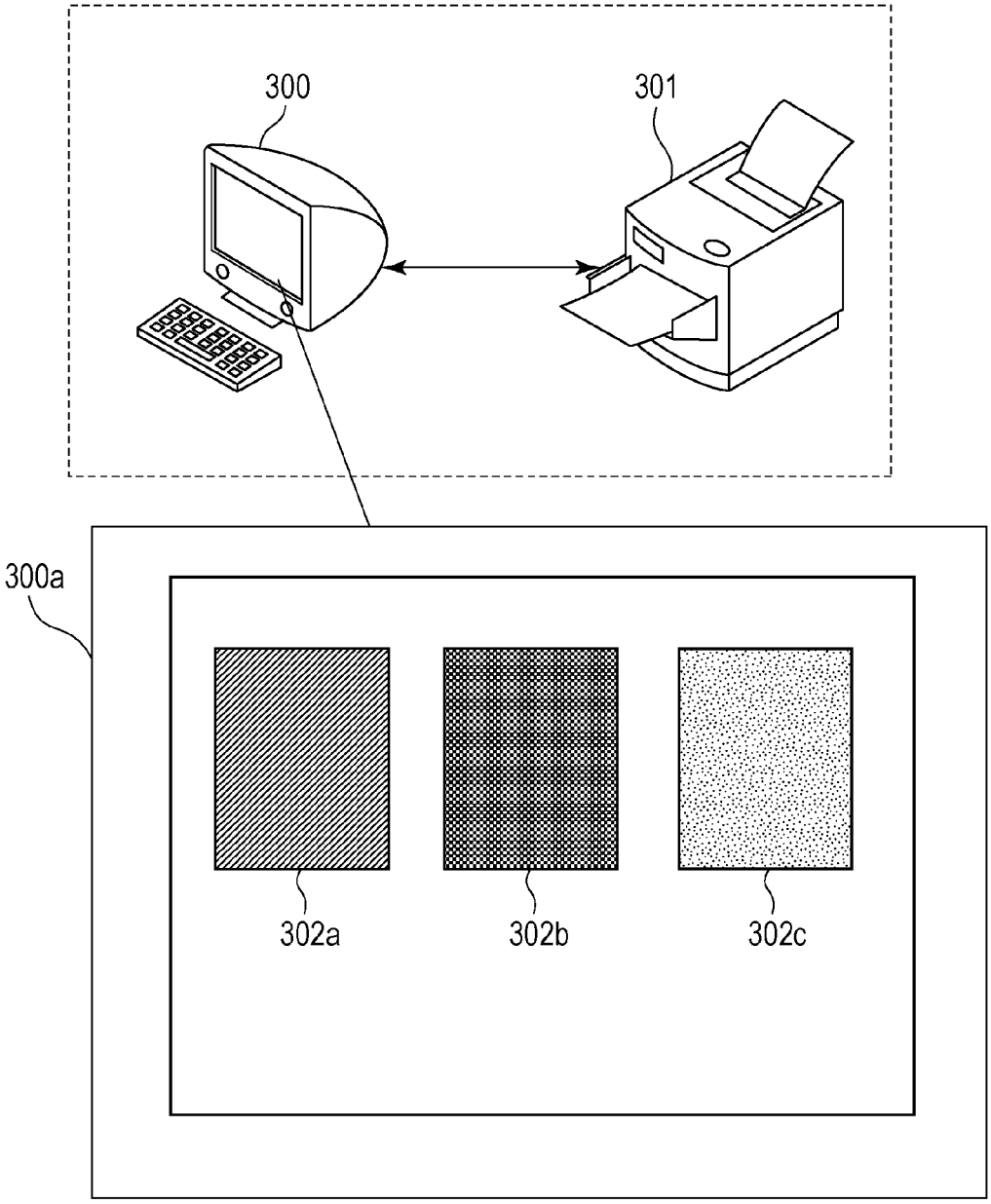
FIG. 7 is a diagram illustrating a schematic structure of an image forming system of the present invention.

An image forming system may be configured by combining the image forming apparatus described in the first and the second embodiments and the computer connected to the image forming apparatus. For example, the user can select the image sample easily by using the computer connected to the image forming apparatus as an input unit and a display unit. An example of the image forming system is illustrated in FIG. 7.

For example, the user can set, from the computer 300, a threshold of each replaceable part using an unillustrated program and unillustrated software (also referred to as a driver) which enable setting of a state and a specification of the image forming apparatus 301.

As an example, regarding the heating apparatus 107 described in the first embodiment, the levels can be set easily by displaying three image quality levels (302*a*, 302*b* and 302*c* of FIG. 7) on a monitor 300*a* of the computer and asking the user to select one from among the images. This is not limited to the heating apparatus 107. A screen on which the user can select a replaceable part may be displayed on the monitor of the computer and, when the user selects a replaceable part, images of image quality levels corresponding to the replaceable part may be displayed.

In this manner, the same effect as that of the configuration described in the first and the second embodiments may be obtained by configuring the image forming system by the image forming apparatus and the computer connected to the image forming apparatus.

In the image forming system of the present embodiment, since the images can be checked on the monitor of the computer and the levels can be selected without printing the images of different image quality levels, print cost can be reduced.

Such an image forming system may be constituted by a computer, a server and a printer which are connected by a public network, such as the Internet. In that case, it is possible to configure the system by a combination of a plurality of computers and a printer, a combination of a plurality of computers and a plurality of printers, and a combination of a computer and a plurality of printers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-248443, filed Nov. 29, 2013, which is hereby incorporated by reference herein in its entirety.

REFERENCE SIGNS LIST

11 CPU
106 Transfer roller
107 Heating apparatus
108 Feed roller
N Nip portion
P Recording material
T Toner

The invention claimed is:

1. An image forming apparatus having a replaceable unit, the image forming apparatus comprising:

an output unit configured to output information indicating that a usage amount of the replaceable unit has reached a threshold value for determining replacement of the replaceable unit;

an input unit configured to input setting information for setting the threshold value; and a control unit configured to set the threshold value in accordance with the setting information input by the input unit, wherein the output unit outputs a first image sample and a second image sample by using the replaceable unit, the second image sample being lower in image quality than the first image sample, wherein, the setting information includes first information corresponding to the first image sample and second information corresponding to the second image sample, wherein, when the first information is input in the control unit, the control unit sets the threshold value to a first threshold, and wherein, when the second information is input in the control unit, the control unit sets the threshold value to a second threshold being different from the first threshold, and wherein the first threshold is smaller than the second threshold.

2. The image forming apparatus according to claim 1, wherein, when the usage amount reaches the first threshold or the second threshold, the output unit outputs information indicating that the replaceable unit has reached an end of a residual life.

3. The image forming apparatus according to claim 1, wherein, when the usage amount reaches the first threshold or the second threshold, the output unit outputs information indicating that the replaceable unit has reached a replacement time.

4. The image forming apparatus according to claim 1, wherein the first image sample and the second image sample are formed on a recording material in order to let the setting information be input from outside of the image forming apparatus, and the recording material on which the first image sample and the second image sample are formed is discharged from the image forming apparatus.

5. The image forming apparatus according to claim 1, comprising a plurality of the replaceable units, wherein, when a usage amount of each of the plurality of the replaceable units reaches a corresponding threshold, the output unit outputs information indicating that each of the units has reached a replacement time.

6. The image forming apparatus according to claim 1, wherein the replaceable unit includes a heating apparatus configured to heat a recording material and fix an image to the recording material.

7. The image forming apparatus according to claim 1, wherein the replaceable unit includes a transfer member configured to transfer the image to a recording material.

8. An image forming system which includes an image forming apparatus and an input device connected to the image forming apparatus, the image forming apparatus having a replaceable unit, the image forming system comprising:

an output unit configured to output information indicating that a usage amount of the replaceable unit has reached a threshold value for determining replacement of the replaceable unit; and a control unit configured to set the threshold value in accordance with setting information input by the input device, wherein the output unit outputs a first image sample and a second image sample by using the replaceable unit, the second image sample being lower in image quality than the first image sample, wherein, the setting information includes first information corresponding to the first image sample and second information corresponding to the second image sample, wherein, when the first information is input in the control unit, the control unit sets the threshold value to a first threshold, and wherein, when the second information is input in the control unit, the control unit sets the threshold value to a second threshold being different from the first threshold, and wherein the first threshold is smaller than the second threshold.

9. The image forming system according to claim 8, wherein the input device includes a computer provided with a display unit, and displays the first image sample and the second image sample on the display unit of the computer.

10. The image forming system according to claim 8, wherein the first image sample and the second image sample are formed on a recording material, and the recording material on which the first image samples and the second image sample are formed is discharged from the image forming apparatus.

* * * * *